US009835326B2

(12) United States Patent
Gonzalez et al.

(10) Patent No.: US 9,835,326 B2
(45) Date of Patent: Dec. 5, 2017

(54) AUTOMATED BIOMASS DISTRIBUTION SYSTEM

(71) Applicant: Valvexport, Inc., Miami, FL (US)

(72) Inventors: Jose Jaime Gonzalez, Bogota (CO); Terence Francis Dixon, Blackbutt (AU)

(73) Assignee: Valvexport, Inc., Jacksonville, FL (US)

( * ) Notice: Subject to any disclaimer, the term of this patent is extended or adjusted under 35 U.S.C. 154(b) by 466 days.

(21) Appl. No.: 14/605,458

(22) Filed: Jan. 26, 2015

(65) Prior Publication Data

US 2015/0211737 A1 Jul. 30, 2015

Related U.S. Application Data

(60) Provisional application No. 61/931,873, filed on Jan. 27, 2014.

(51) Int. Cl.

| | |
|---|---|
| ***F23B 40/02*** | (2006.01) |
| ***F23G 7/10*** | (2006.01) |
| ***F23K 3/18*** | (2006.01) |
| ***F23G 5/00*** | (2006.01) |
| ***F23G 5/44*** | (2006.01) |
| ***F23G 5/50*** | (2006.01) |

(52) U.S. Cl.

CPC ..... *F23B 40/02* (2013.01); *F23G 5/002* (2013.01); *F23G 5/444* (2013.01); *F23G 5/50* (2013.01); *F23G 7/10* (2013.01); *F23K 3/18* (2013.01); *F23G 2203/401* (2013.01); *F23G 2205/20* (2013.01)

(58) Field of Classification Search

CPC ... F23G 5/444; F23G 5/50; F23G 7/10; F23G 5/002; F23G 2205/20; F23B 40/02; F23K 3/18; F23K 3/20

See application file for complete search history.

(56) References Cited

U.S. PATENT DOCUMENTS

| | | | | | |
|---|---|---|---|---|---|
| 1,243,186 | A * | 10/1917 | Kohout | F23K 3/00 | 110/104 R |
| 1,504,528 | A * | 8/1924 | Strandrud | F23K 3/00 | 110/102 |
| 2,130,329 | A * | 9/1938 | Sammons | F23K 3/18 | 110/104 R |
| 2,773,629 | A * | 12/1956 | Miller | F23D 91/02 | 110/102 |
| 3,241,506 | A * | 3/1966 | Miner, Jr. | F23K 3/00 | 110/105.5 |
| 4,056,069 | A * | 11/1977 | Marshall | F23C 1/06 | 110/346 |
| 4,102,278 | A * | 7/1978 | McManama | F23K 3/02 | 110/105 |
| 4,326,469 | A * | 4/1982 | Reschly | F23K 3/18 | 110/104 R |

(Continued)

*Primary Examiner* — David J Laux
(74) *Attorney, Agent, or Firm* — Ashkan Najafi

(57) ABSTRACT

A biomass energy system utilizes an automated biomass distribution system for evenly distributing biomass within a furnace of the biomass energy system. The even distribution of biomass dramatically increases efficiency of the biomass energy system. The automated biomass distribution system includes a control unit, a set of I/P control boxes, and a set of valve assemblies. Each valve assembly includes a pneumatic actuator, a plug and a discharge duct matching the shape of the plug.

4 Claims, 9 Drawing Sheets

(56) References Cited

U.S. PATENT DOCUMENTS

| | | | | | |
|---|---|---|---|---|---|
| 4,528,917 | A * | 7/1985 | Jacobs | F23B 1/16 | 110/101 CF |
| 4,532,872 | A * | 8/1985 | Anderson | F23B 5/02 | 110/245 |
| 4,648,329 | A * | 3/1987 | Couarc'h | F23B 5/02 | 110/245 |
| 4,905,613 | A * | 3/1990 | Reschly | F23K 3/18 | 110/101 C |
| 5,239,935 | A * | 8/1993 | Morrow | F23K 3/18 | 110/104 R |
| 5,794,548 | A * | 8/1998 | Barlow | F23K 3/18 | 110/104 R |
| 5,829,368 | A * | 11/1998 | Cote | F23C 10/22 | 110/101 CF |
| 8,276,528 | B1 * | 10/2012 | Higgins | F23C 9/00 | 110/104 R |
| 8,707,876 | B2 * | 4/2014 | Higgins | F23B 30/06 | 110/347 |
| 9,482,428 | B2 * | 11/2016 | DeSellem | F23C 1/10 | |
| 2010/0323310 | A1 * | 12/2010 | Baumann | F23K 3/18 | 431/12 |

* cited by examiner (Prior Art)

(Prior Art)

TYPICAL OPERATIONAL CURVES FOR HIGH EFFICIENCY VALUES

*Fig. 7A* Valve closed

*Fig. 7B* Valve open

*Fig. 7C* Plug displacement versus actuator pressure Pc

*Fig. 7D* Nozzle pressure Pn versus plug displacement

*Fig. 7E* Nozzle pressure Pn versus control signal mA

EXAMPLE OF NOZZLE PRESSURE CYCLE GRAPHS WHEN SELECTOR IS POSITIONED ALL "CYCLE START" POSITION

EXAMPLE OF NOZZLE PRESSURE CYCLE GRAPHS WHEN SELECTOR IS POSITIONED ALL "CYCLE START" POSITION

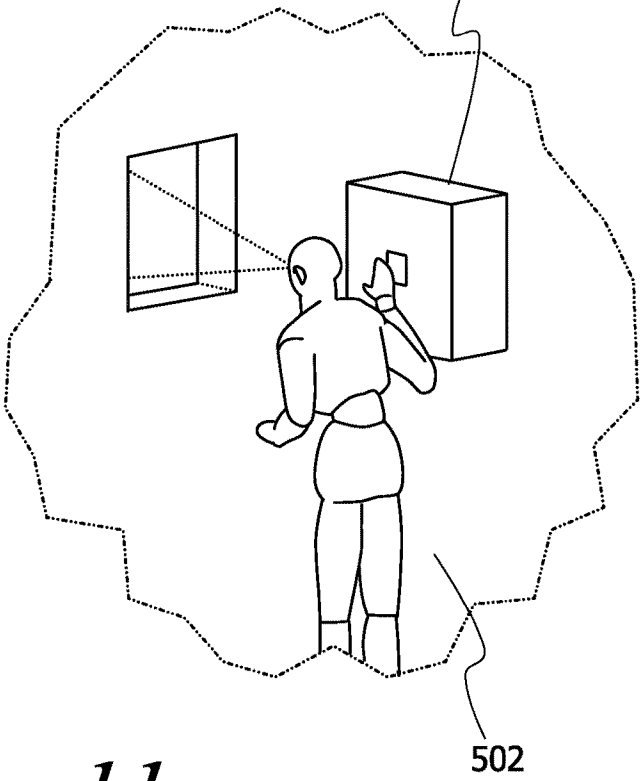
Fig. 11B
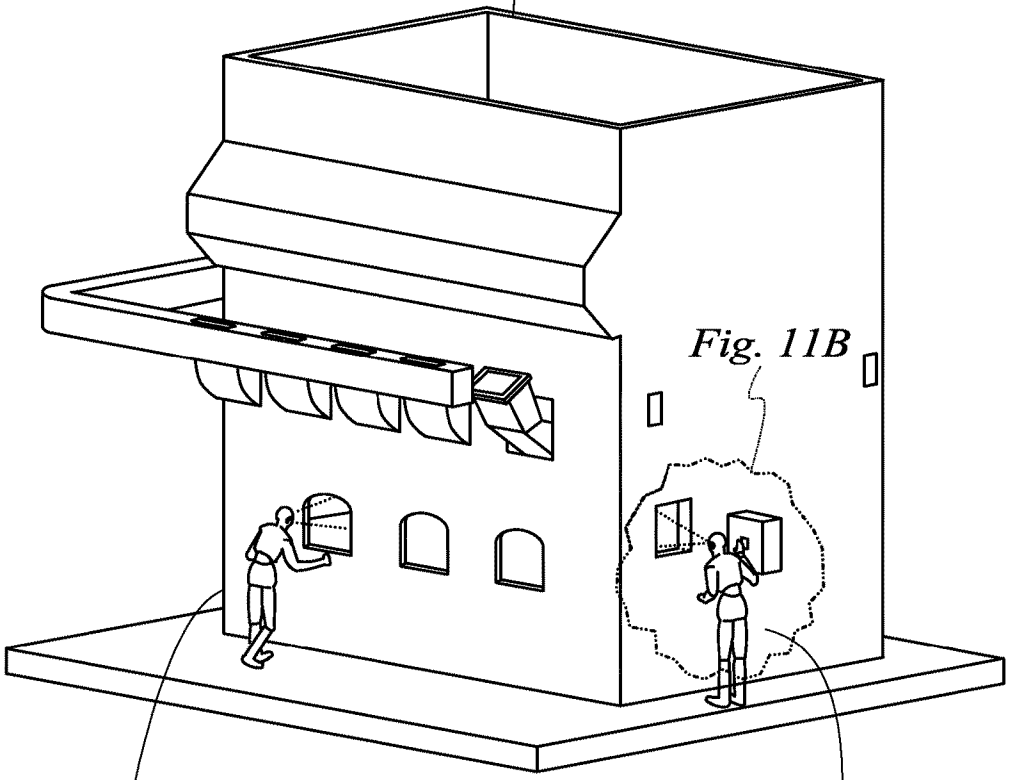
Fig. 11A
Fig. 11

AUTOMATED BIOMASS DISTRIBUTION SYSTEM

CROSS-REFERENCE TO RELATED APPLICATIONS

This application claims the benefit and priority of U.S. patent application Ser. No. 61/931,873, entitled "AUTOMATED BIOMASS AIR SWEEPING SYSTEM," filed Jan. 27, 2014, assigned to Valvexport, Inc. of Miami, Fla., and which is hereby incorporated by reference in its entirety.

FIELD OF THE DISCLOSURE

The present disclosure generally relates to an energy production system. More particularly, the present disclosure relates to a biomass stoker boiler. More particularly still, the present disclosure relates to a biomass air spreading system for evenly distributing biomass over a stoker boiler furnace grate.

DESCRIPTION OF BACKGROUND

Biomass is biological material, such as plants or plant-derived materials. Biomass is a renewable energy source when burned to produce heat, or converted to various forms of bio-fuel. The thermal method to generate energy or electricity from biomass usually involves a stoker boiler with a furnace for burning the biomass that is fed into it. For many years, since the first biomass boilers where designed and manufactured, biomass was seen as a waste material that needed to be incinerated. During the last 20 years, with the escalating cost of fuels used to generate electricity, a new vision of biomass as a renewable fuel is changing the design conception of these boilers. Higher thermal efficiencies with lower particulate emissions are driving many boiler design changes. Controlled biomass deposition on the furnace grate using improved air spreading systems is one of the major goals encountered in the new designs. Trying to avoid biomass piling on the grate, many boilers are operated with excess air as well as high carryover of unburned particulate.

Some studies on sugar cane bagasse fired boilers have found that maintaining a uniform thin bed of bagasse, between 1" and 3" inches (25 to 75 mm) deep, over the complete area of the grate, assures a continuously burning grate bed which rapidly dries and heats the bagasse fibers in suspension, acting as pilot flames for the incoming fuel stream. When the bed is partially uncovered or has very thin beds, less than 1" inch deep (about 25 mm), the ignition zone, immediately above contains an unstable and highly fluctuating flame of low luminosity that induces combustion cycling which becomes evident with furnace puffing or cycled pressurization. When the bagasse accumulates in piles above 6" (meaning six inches) deep, it reduces the grate heat release. Accordingly, optimizing partial biomass distribution on the grate, while burning the rest in suspension, with minimum excess air, is ideal for stable combustion and efficient steam generation.

FIG. 1 depicts a prior art biomass spreading system 120, coupled to a furnace 104 of a typical boiler 100 including a grate 106. The grate 106 can be fixed or travelling in a horizontal or inclined fashion. The grate 106 illustrated in FIG. 1 is a horizontal stationary pinhole grate. Various Biomass distributors 108 are attached to a front wall 109 of the furnace 104. Through the biomass distributors 108, biomass material 132 is fed into the furnace 104. Under grate air 142 is fed into a furnace chamber 133 by a forced fan 135. Air passes through many small holes on the grate 106 to provide oxygen for burning the biomass material 132. To distribute the biomass material 132 over the furnace grate 106, a biomass distribution system 120 is operatively coupled to the biomass distributors 108.

FIG. 2 presents a zoomed view of FIG. 1, and details of the biomass distribution system 120 that is operatively coupled to the distributor 108. The biomass material 132 is spread into the furnace 104 by the sweeping action of air passing through a narrowly slotted passage 131 which is a part of the biomass distributor 108. The air is supplied by the fan 110. The distribution system 120 includes a main header 122, which feeds various secondary ducts 123 that in turn feed various valve housings 124. Each valve housing 124 contains one or two dampers. One of the dampers is a rotary damper 126, while the other, if it exists, is a manual damper 127. As air flows from the valve housing inlet 121 through the passages left open by the dampers 126 and 127, it loses pressure depending on the variable open area of these passages. The valve housing outlet 150 discharges into a header 151 after a 90° (meaning 90 degrees) air flow turn from the valve housing 124. Another 90° flow turn is required to exit the header 151 and enter a rectangular duct 152 which connects to the distributor 108 with a flange 153.

The sudden changes in direction of the air flow as well as the sudden contractions described above create high turbulence and high pressure drops, and thereby reducing the effectiveness of the air jet 130 in sweeping the biomass material 132 into the boiler 100. An electric motor (not shown) provides rotation to a shaft 125, common to all the rotary dampers 126, inside the valve housings 124. The valve housings 124 feed sweeping air to all the biomass distributors 108 in a stoker boiler. The rotary damper blade 126 of each valve housing 124 is set in a position different from the rest, so that they will create different pressure drops as the blades 126 rotate simultaneously. In other words, when one damper 126 is in the open position, the other dampers 126 are closed to various degrees. Accordingly, each blade 126 is at a different rotation position from the other blades 126. The manual dampers 127 are set individually, based on the boiler operators' experience, to establish a minimum sweeping flow to help distribute the biomass evenly over the grate 104.

When any rotary damper 126 is at the closed position, it partially or substantially blocks the air flow from the secondary duct 123 to the discharge duct 152. In such a case, the biomass distribution system 120 provides the lowest air pressure in the discharge duct 152, minimizing the air sweeping action for biomass spreading. After the rotary damper 126 rotates 90° from the closed position, it is in the open position. At the open position, the rotary valve 126 provides the least resistance to the air flow from the secondary duct 123 to the discharge duct 152. In other words, when the rotary valve 126 is at the open position, the biomass distribution system 120 provides the highest air pressure in the discharge duct 152, maximizing the air sweeping action for biomass spreading.

Air flows from the discharge duct 152 into distributor 108 and through the air sweeping nozzle 131, thereby creating the air jet 130. The biomass material 132 is fed vertically down into the distributor 108 by a biomass feeder (not shown). The air jet 130 velocity (meaning the velocity of the air jet 130) is the result of the air flow contraction as it passes through the air sweeping nozzle 131, and encounters the biomass material 132 falling through the distributor 108. The air jet 130 momentum (meaning air mass multiplied by air velocity of the air jet 130), created by the air jet 130 passing through the air sweeping nozzle 131, pushes the biomass 132 into the furnace 104. When the air pressure in the discharge duct 152 is at the highest point, the air jet momentum is expected to be the highest level and the biomass material 132 moves furthest into the furnace 104. In such a case, the biomass material 132 falls onto an area of the grate 106 that is close to a back wall 107 (see FIG. 1) of the furnace 104. In contrast, when the air pressure in the discharge duct 152 is at the lowest level, the biomass material 132 travels a shortest distance into the furnace 104 and falls on the area of the grate 106 that is closest to the front wall 109.

Even distribution of the biomass material 132 over the grate 106 is very important for the reasons described above and other reasons described below. For example, an even distribution allows for higher biomass burning capacities as well as higher and more stable heat release rates, which in turn provide higher boiler steam generation at stable pressure and temperature. As an additional example, the thermal efficiency of a biomass stoker boiler is reduced when the biomass covers the grate unevenly, meaning that some areas have a thick bed while other areas have a thin bed. The uneven distribution of biomass 132 on the grate 106 forces the operators to work with more excess air, an unnecessarily high quantity of unburned fibers and incombustibles carried over by the flue gases.

Accordingly, the prior art biomass distribution system 120 fails to spread the biomass material 132 evenly over the furnace grate 106. The main reason for the failure is that the system 120 cannot control the momentum variation of the air jet flow 130, with respect to time or observed biomass bed deposition depth over the grate 106. Such limitation of the system 120 is caused by a number of reasons. First, the system 120 does not provide a controlled air jet 130 momentum variation with respect to time, because it does not provide a controlled variation of pressure behind the air sweeping nozzle 131 during the damper rotating cycle. Second, the system 120 does not allow for individual adjustment of air pressure to a distributor 108 independently from the other distributors 108, because the system 120 is operated by a single motor through a common shaft. Third, the system 120 creates high air pressure losses and turbulence that reduce the sweeping effectiveness of the air jet 130, thereby requiring higher fan pressures and causing higher energy cost and less sweeping control.

FIG. 3 illustrates a graph depicting the typical air pressure behind the prior art air sweeping nozzle 131 (10 to 20 inches of water column ("inWC")) during a cycle of ten (10) seconds corresponding to a 90° rotation of the damper 126. As shown by the graph, during the latter 35% of the cycle (about three and a half seconds), the air pressure behind the sweeping nozzle 131 stays almost constant at 18 inWC. Beyond the first six seconds of the cycle, the air pressure decays almost linearly from 17 to 7 inWC. Accordingly, the graph indicates that most of the biomass 132 is spread towards the rear zone of the furnace grate 106. In other words, piles of the biomass 132 are formed in the rear zone of the grate 106 and are not burned efficiently. In contrast, the section of the grate 106 near the front wall 109 tends to remain uncovered, thereby lowering heat release rates. In fact most prior art biomass boilers depend on frequent manual spreading of the piled biomass in order to maintain desired steam production levels. The manual spreading is accomplished by opening manhole doors (not shown) located at the front wall 109 and below the distributor 108 openings, manually introducing long spreading rakes, and dragging the piled biomass so as to spread it evenly over the depth and width of the grate 106.

To correct the uneven distribution of the biomass material 132 over the grate 106, operators of the system 120 usually try to throttle the air pressure. However, the reduction in the air pressure fails to solve the problem of uneven distribution of the biomass material 132 over the grate 106. Rather, the reduction in the air pressure shifts the uneven deposition of the biomass 132 towards the front section of the grate 106. In addition to the problem of uneven distribution along the depth of furnace grate 106, there is the problem of uneven distribution across the width of the furnace grate 106 due to variations in feeder discharge. The system 120 does not allow individual adjustments of each air jet 130 to each distributor 108 over the complete cycle, it can only effect de minimis adjustments in air flow passing through the manually adjustable damper 127.

Neither does the prior art system 120 allow for individual adjustments to each jet flow 130 in response to higher bagasse density and/or friction as it moves through the distributor 108. Higher bagasse density is caused by, for example, higher moisture content. Another disadvantage of the prior art system 120 is that it creates very high turbulence and pressure losses for numerous reasons, such as inefficient flow throttling through single blade butterfly dampers, sudden changes in direction and flow contractions as air flows through the valve housing 124 and into the lateral exit port 150, and sudden change in flow direction as air flows out of the header 151 into the lateral rectangular duct 152. The air flow is highly irregular and thus creates high turbulence when it exits the duct 152. The momentum of air jet 130 is thus reduced. In other words, the current state of the art distribution system 120 fails to provide even biomass distribution. Such shortcomings of the prior art system become even worse when there is higher moisture content or uneven biomass feeding from one feeder to another. Furthermore, the system 120 consumes more fan power than necessary.

Accordingly, there is a need for a new biomass distribution system that evenly distributes biomass over a grate surface.

OBJECTS OF THE DISCLOSED SYSTEM, METHOD, AND APPARATUS

Accordingly, it is an object of this disclosure to provide an improved biomass air spreading system for use with stoker boilers.

Another object of this disclosure is to provide an improved biomass air spreading system for evenly distributing biomass over the width and depth of a stoker boiler grate surface.

Another object of this disclosure is to provide an improved biomass air spreading system requiring lower energy consumption for fan operation.

Another object of this disclosure is to provide an improved biomass air spreading system utilizing multiple high efficiency air valve assemblies.

Another object of this disclosure is to provide an improved biomass air spreading system utilizing multiple high efficiency valve assemblies, each one of which includes an actuator and an actuator control box.

Another object of this disclosure is to provide a programmable automated biomass air spreading system for use with stoker boilers.

Another object of this disclosure is to provide an improved biomass air spreading system which can be tuned online through a computer interface, in such a way as to maintain, at all times, an optimum biomass distribution on the furnace grate.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

Generally speaking, pursuant to the various embodiments, the present disclosure provides a programmable and automated biomass air spreading system for multiple distributors in a stoker boiler. In accordance with the present teachings. The air spreading system includes a central control unit which holds various operational programs. These programs can be modified during boiler operation. The central control unit delivers preprogrammed pneumatic signals to actuators, operatively coupled to a set of high efficiency valve assemblies, which in turn are coupled to a set of biomass distributors on the boiler.

Further in accordance with the present teachings is a biomass distribution system that includes a central control unit adapted to generate a set of control signals, and a set of converters connected to the central control unit. Each converter within the set of converters is adapted to receive a subset of control signals of the set of control signals and convert the received subset of control signals into a set of air pressure signals. The system also includes a set of actuators connected to the set of converters respectively. Each actuator within the set of actuators receives the set of air pressure signals from a corresponding converter within the set of converters. In addition, the system includes a set of valve plugs operatively coupled to the set of actuators through a set of spindles respectively. Each valve plug within the set of valve plugs is actuated by a corresponding actuator within the set of actuators through a spindle within the set of spindles in response to each air pressure signal within the set of air pressure signals. The system further includes a set of discharge ducts operatively coupled to a set of biomass distributors. The set of biomass distributors are attached to a furnace of a boiler stoker and adapted to receive biomass. The furnace includes a grate for burning the biomass. Each discharge duct within the set of discharge ducts receives a portion of a corresponding valve plug within the set of valve plugs to form a throttling passage to regulate airflow moving into a corresponding biomass distributor through the throttling passage. The airflow moves biomass over the grate. A nozzle pressure of the airflow corresponds to an air pressure signal within the set of air pressure signals. The airflow is provided by an air supplier through a main duct.

Further in accordance with the present teachings is a method for regulating airflow provided to a furnace of a boiler stoker. The method includes a central control unit generating a set of control signals, and each valve plug within the set of valve plugs is partially received by a corresponding discharge duct that is operatively coupled to a corresponding biomass distributor. In addition, the method includes each converter within a set of converters converting the subset of control signals into a set of air pressure signals, and each actuator within the set of actuators receiving the set of air pressure signals from a corresponding converter within the set of converters. The method further includes, based on the set of air pressure signals, each actuator within the set of actuators actuating a corresponding valve plug within a set of valve plugs. The set of actuators is operatively coupled to the set of valve plugs through a set of spindles respectively. Each valve plug within the set of valve plugs is partially received by a corresponding discharge duct that is operatively coupled to a corresponding biomass distributor. Each biomass distributor is attached to a furnace of a boiler stoker. Each discharge duct and a corresponding valve plug within the set of valve plugs form a throttling passage to regulate airflow moving into a corresponding biomass distributor through the throttling passage. The airflow moves biomass over a grate inside the furnace. A nozzle pressure of the airflow corresponds to an air pressure signal within the set of air pressure signals. The airflow is provided by an air supplier through a main duct.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 11A depicts a schematic drawing of a stoker boiler constructed in accordance with this disclosure.

FIG. 11B is a zoomed view of FIG. 11A.

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figure 1:
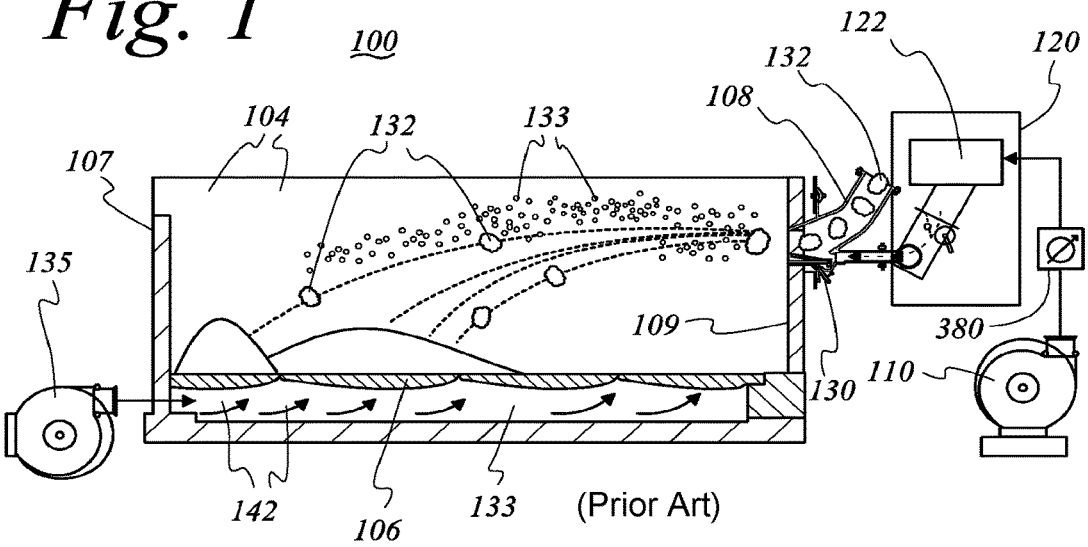
FIG. 1 is a system diagram depicting a prior art biomass boiler spreading system.
Figure 2:
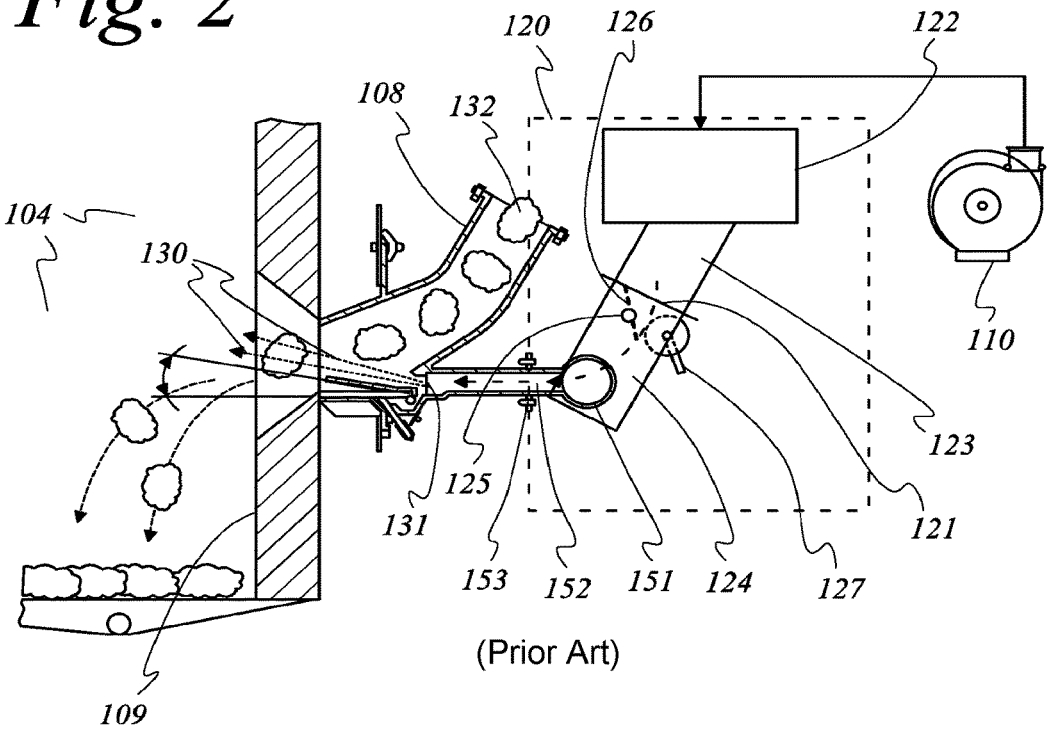
(Prior Art) Fig. 2
FIG. 2 is a zoomed view of a prior art biomass boiler spreading system.
Figure 3:
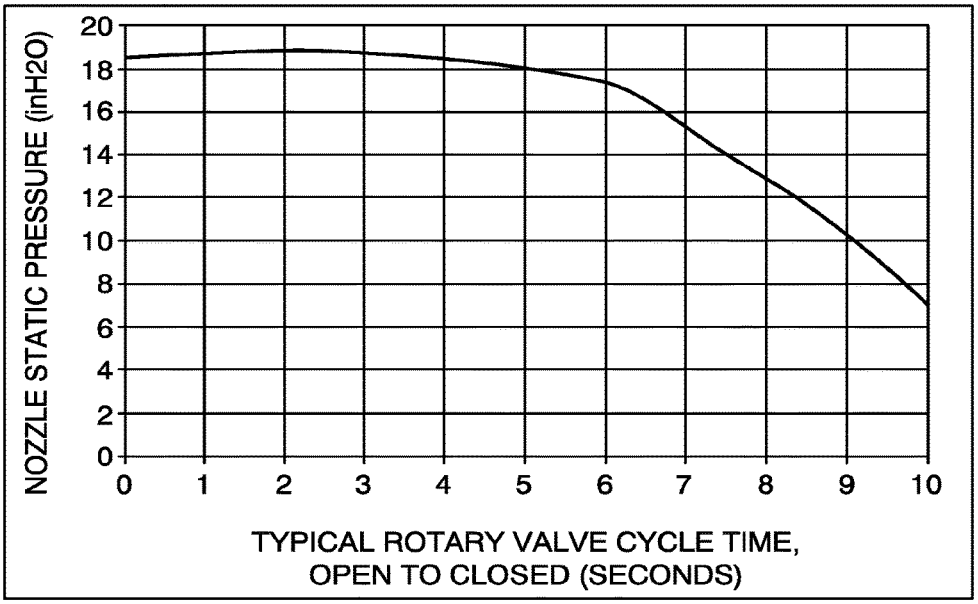
FIG. 3 illustrates a graph depicting the relationship between static pressure behind the air sweeping nozzle versus cycle time in a prior art sweeping system.
Figure 4:
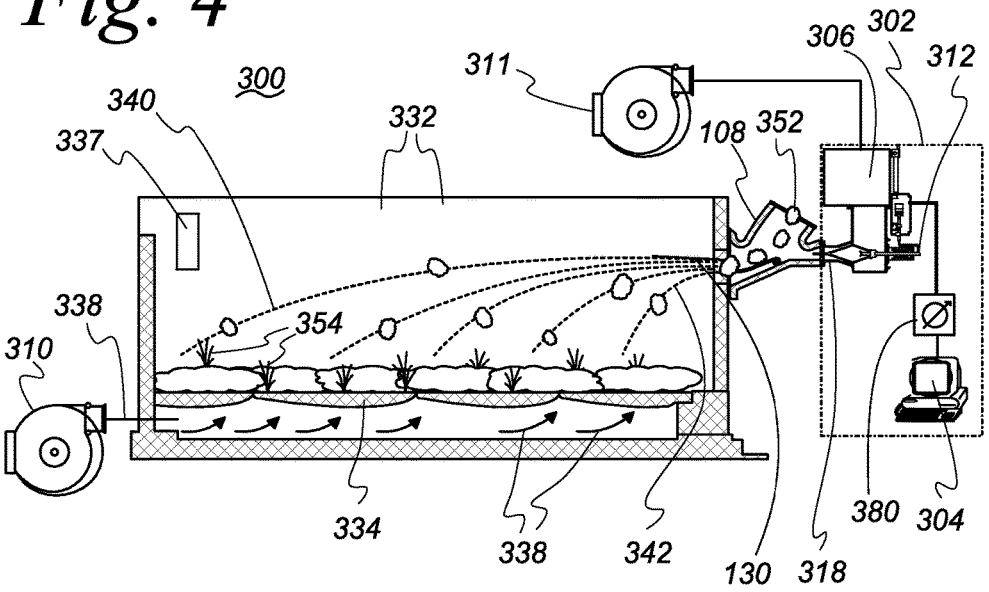
FIG. 4 illustrates a system diagram depicting a boiler furnace with a biomass spreading system in accordance with this disclosure.

Turning to the Figures and to FIG. 4 in particular, a boiler stoker 300 with an improved biomass spreading system 302 is shown. The boiler stoker 300 includes a furnace 332 having a grate 334 and various distributors 108 through which biomass material 352 enters into the furnace 332 and falls on the grate 334. The biomass material 352 is fed into the distributors 108 by a feeder (not shown). The biomass material 352 is distributed based on the momentum of an air jet 130, which is controlled as described herein. In one implementation, the grate 334 is a pinhole grate. Alternatively, the grate 334 is a vibrating grate, or any other type of grate known to a person of ordinary skills in the art. Under grate air 338 is provided by an air supplier 310. Air 338 further flows through many holes evenly distributed in the grate 334 and mixes with the biomass material 352. When the biomass material 352 is burned, flames 354 are created inside the furnace 332. When the biomass material 352 is evenly distributed over the grate 334 by the system 302, the flames 354 are usually short flames. Furthermore, short flames cover the entire area of the grate 334, and thus create stable combustion inside an interior chamber of the furnace 332.

Figure 8:
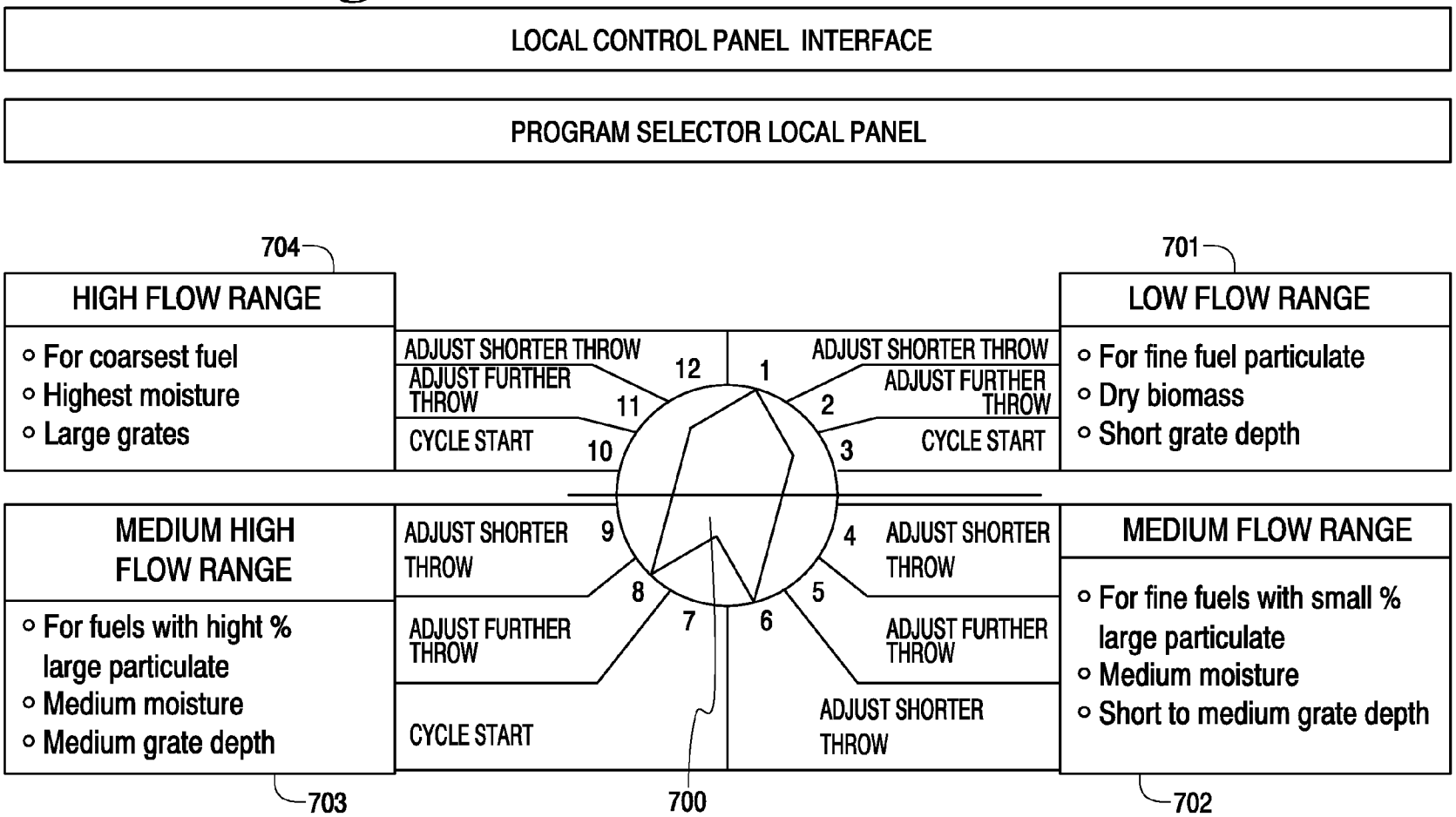
FIG. 8 depicts the program selector from a local control panel constructed in accordance with this disclosure.

The improved biomass distribution system 302 includes a central control unit 304, such as a Programmable Logic Controller ("PLC"), Distributed Control System ("DCS") or Supervisory Control And Data Acquisition ("SCADA") system. The central control unit 304 generates current or voltage control signals. In one implementation, the control unit 304 is a PLC connected to an engineering workstation (not shown) and an application server (not shown), which sends the programmed control signals to individual control boxes 380. In another implementation, a local control panel 380 holds all the I/P transducers and a PLC, which contains various programs. A selector switch or a touch screen monitor allow the boiler operator to choose from various programs. The interface screen or front panel clearly indicates the application for each selector position, as depicted in FIG. 8. View port (or ports) 337 allows an operator to observe the distribution of biomass 352 over the grate 334.

Figure 5:
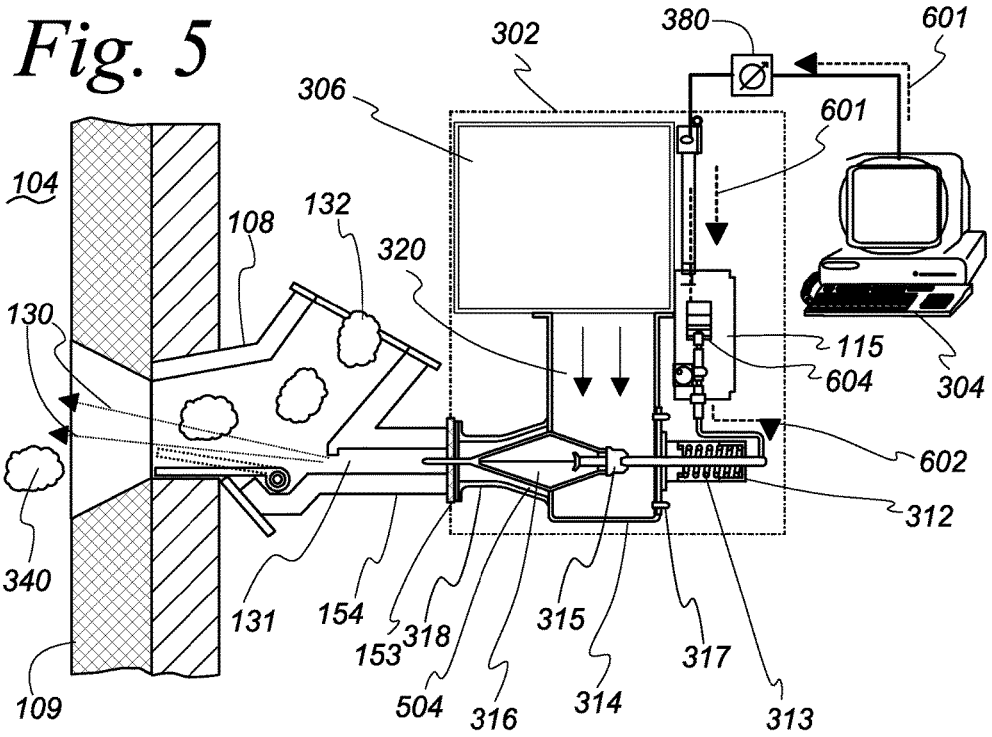
FIG. 5 is a cross sectional view of a high efficiency valve assembly, with its pneumatic actuator, local control box, main header and cables connecting to a main or local control panel in accordance with this disclosure.

Referring to FIG. 5, a cross sectional view of the system 302 is shown. The current or voltage signals 601 are sent by the central control unit 304 and received by local control device 380, which can be a local control panel or local control box (or boxes). I/P (meaning current to pressure) or V/P (meaning voltage to pressure) transducers 604 within the local control device 380, convert the signals 601 into air pressure signals 602. The air pressure signals 602 are used to operate a pneumatic actuators 312. When the air pressure signal 602 is increased, an actuator spindle 315 of the actuator 312 extends forward. As the actuator spindle of the actuator 312 extends, the actuator 312 displaces a valve plug 316 within a valve housing 314 towards a contracting discharge duct 318. A spring 313, inside the pneumatic actuator 312, retracts the plug 316 when the air pressure signal 602 is decreased. As used herein, each local control device 380 and the transducer 604 within it is said to be connected and operatively coupled to a corresponding actuator 312 and the central control unit 304; and each valve plug 316 is said be to operatively coupled to a corresponding actuator 312 through a spindle 315.

In other words, as the plug 316, displaces forward or retracts, it efficiently converts part of the static pressure of the air behind the plug 316, into dynamic pressure in the throttling passages 504, between the plug 316 and the contracting duct 318, and back into static pressure at the discharge duct 318. To evenly distribute the biomass material 352 over the grate 334 (see FIG. 4), the distribution system 302 provides airflow at variable pressure through the contracting discharge duct 318 which is operatively coupled to the distributor 108. As the biomass material 352 falls into the distributor 108, the airflow from the discharge duct 318 blows the biomass 352 into the furnace 332. The sweeping nozzle 131 and flange 153 operate as described in the background. In certain embodiments, an intermediate duct 154 is used to connect the distribution system 302 to the distributor 108, thereby allowing control of The air flow at a higher air pressure in the discharge duct 318 moves the biomass material 352 along a longer trajectory 340 (see FIG. 4) and delivers it to the far side of the grate 334 away from the distributor 108. In contrast, when the air pressure at the contracting discharge duct 318 is lower, the biomass material 352 travels a shorter trajectory 342 (see FIG. 4) and falls on the near side of the grate 334 that is closer to the distributor 108. The air pressure at the contracting discharge duct 318 is controlled by the valve plug 316 position, which in turn is programmed and controlled by the control unit 304 through the I/P or V/P transducers 604 inside the local control device 380.

Air flows through a main duct 306 receiving air from an air supplier 311, to the valve housings 314, through openings 320 that match the valve housing inlet. The discharge duct 318 is connected to the biomass distributor 108. Each valve housing 314 incorporates a local control device 380. The biomass material 352 enters the furnace 332, while air flows into the distributor 108 from the duct 318.

In one embodiment of the present teachings, each local control device 380 contains a controller or transducer which converts the control signals 601 from the central control unit 304, to pneumatic control signals 602 fed to the actuators 312. The air supplied to the converter or transducer 604, is known as instrumentation air, at a pressure higher than the air sweeping pressure. The instrumentation air pressure is usually between 60 to 100 PSI (meaning pounds per square inch). For example, the signal from the central control unit is 4-20 mA (meaning milliamps) and the pneumatic signal to the actuator 312 is 6-30 PSI. The air sweeping pressures are usually between 0.5 to 1 PSI. In another implementation a local control panel 380 contains the transducers for the valves.

In one implementation, the actuator 312 is attached to the inlet housing 314 through a cover plate 317 which also provides access for inserting the valve plug 316 into the valve housing 314. The spring return pneumatic actuator 312 provides forces to displace the plug 316 with a plug spindle 315. In other words, the plug spindle 315 transfers force from the actuator 312 to the plug 316. Depending on the air pressure signal 602 that the actuator 312 receives from the local control device 380, the actuator 312 drives the plug 316 towards or away from the discharge duct 318. When lower sweeping air pressure is desired for the airflow, the plug 316 is pushed toward the discharge duct 318. Accordingly, the space between the plug 316 and the duct 318 becomes smaller, and less air flows around the plug 316 and into the duct 318. On the contrary, when higher air pressure is desired for the airflow, the plug 316 is pulled away from the discharge duct 318. Accordingly, the space between the plug 316 and the duct 318 becomes bigger, and more air flows around the plug 316 and into the duct 318. In other words, the position of the plug 316 determines the air pressure of the airflow (also referred to herein as nozzle pressure).

The contoured plug 316 and the contoured discharge duct 318 are designed to embody matching physical shapes to allow precise control of the nozzle pressure while minimizing pressure losses when the highest flows are required. In one implementation, the contoured plug 316 is substantially in the shape of a diamond. Accordingly, the front end of the contoured plug 316 incorporates surfaces that are substantially parallel to the surfaces of the rear end of the duct 318. In other words, the top surface of the front end of the plug 316 is substantially parallel to the inner top surface of the rear end of the duct 318; and the bottom surface of the front end of the plug 316 is substantially parallel to the inner bottom surface of the rear end of the duct 318. Accordingly, it can be said that the front end of the plug 316 and the rear end of the duct 318 have substantially the same geometric shape. Other plug shapes may be designed in order to obtain certain flow characterizations with respect to plug positioning as it approaches the discharge duct.

Figure 6:
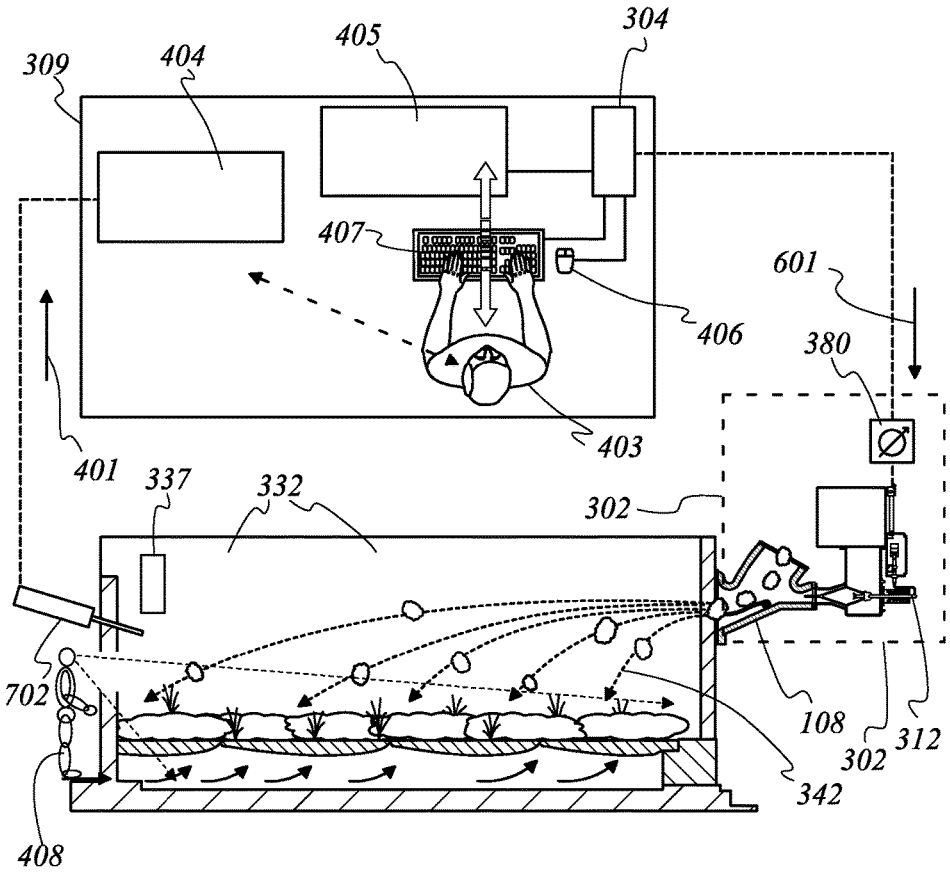
FIG. 6 is a block diagram illustrating a boiler furnace with an improved biomass spreading system in accordance with this disclosure.

Referring to FIG. 6, a block diagram illustrating a boiler furnace with an improved biomass spreading system in accordance with this disclosure is depicted. The boiler furnace includes a typical furnace 332, with an automatic, programmable biomass spreading system 302 coupled to the biomass distributors 108, a video camera 702 installed on a furnace wall, a video monitor 404 receiving the video signals 401 from video camera 702 and a central control unit 304 sending control signals 601 to the local control panel 380. A boiler control room operator 403, observes the video image sent by the camera 702 and displayed on the monitor 404, identifies the position where uneven biomass distribution problems exist and the corresponding location over the grate surface. The boiler operator 403 uses a mouse 406, a keyboard 407 or a touch screen 405 to input the bed depth changes observed on the camera monitor 404 to the central control unit 304. The central control unit 304, the monitor 404, the keyboard 407, the mouse 406 and the touch screen 405 can be disposed within a central control room 309.

In a separate embodiment, when a video image is not available to the central control unit 304, the local operator 408, observes the biomass distribution on the grate through view ports 337 on the furnace walls, changing the programs manually on the local control panel 380.

The programs, stored in the central control unit 304 or in the local control panel 380, define the current or voltage signals sent to each high efficiency valve assembly as well as the duration of each signal. A current or voltage value held during a preprogrammed time period is referred to herein as a programmed pulse. Turning now to FIGS. 9A, 9B, 9C, and 9D, graphs of air pressure versus elapsed cycle time are shown. It can be observed that the pressure pulses can vary according to any desired relationship. These programmed air pulses 602 are sequentially emitted based on control signals 601, one after the other, to the valve actuator 312 until completing a predetermined total time. The predetermined total time is referred to herein as a valve program cycle. Each programmed pulse corresponds to a plug position of the plug 316 within the contracting discharge duct 318. Accordingly, the central control unit 304 provides for a precise control of the valve throttling passages 504 and controls the discharge duct pressure.

Figure 7:
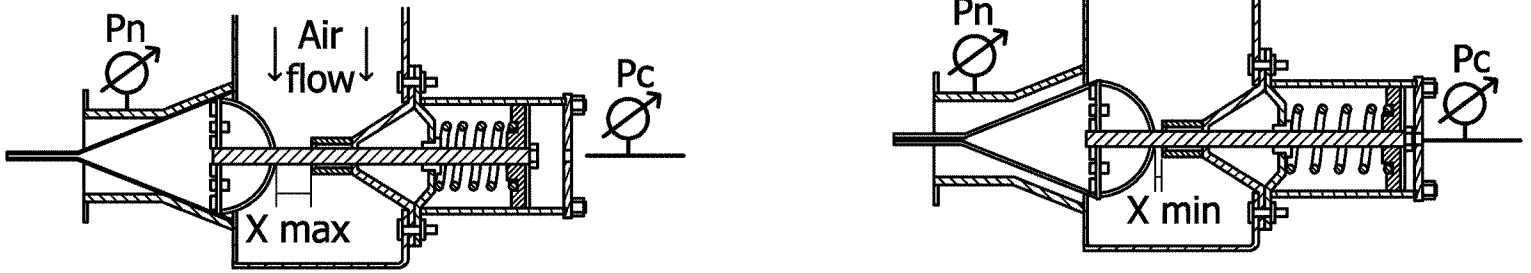
FIGS. 7A and 7B are schematic drawings of the high efficiency valve with the plug in fully closed and fully open positions as constructed in accordance with this disclosure.
FIGS. 7C, 7D and 7E depict graphs of the operational parameters of the high efficiency valves constructed in accordance with this disclosure.
Figure 7:
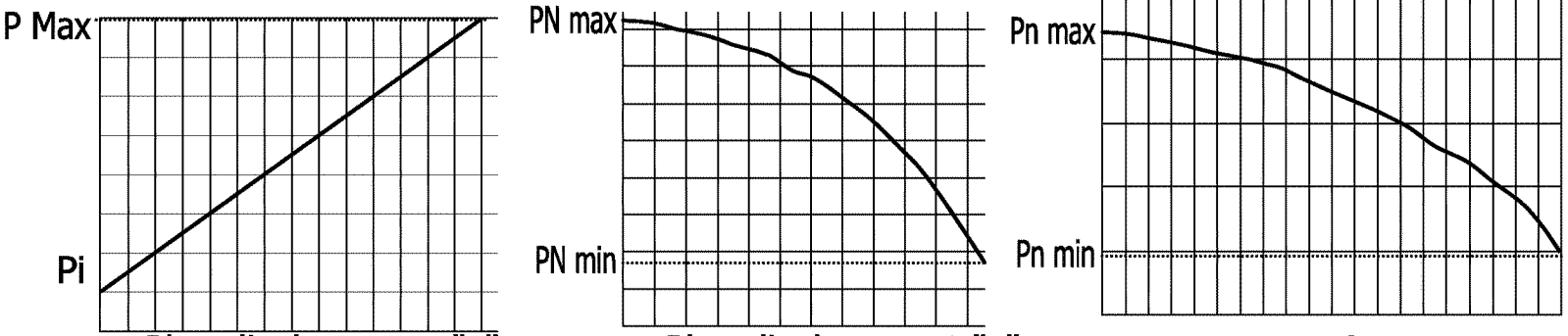

Referring to FIGS. 7A and 7B, these figures represent two extreme positions of the valve plug—fully closed and fully opened respectively. Plug displacement is represented by dimension 'X' in both drawings.

FIG. 7C depicts a graph of plug displacement versus actuator pressure. As As is apparent, actuator pressure gradually increases with plug displacement 'X'.

FIG. 7D depicts a graph of nozzle pressure versus plug displacement. As is apparent, nozzle pressure generally decreases with plug displacement 'X'.

FIG. 7E depicts a graph of nozzle pressure versus control signal current as measured in milliamps (mA).

The aforementioned graphs have proven to be consistent from valve to valve, allowing precise repetitive pressure steps, which in turn provides predictable nozzle pressures at any time within the pre-programmed cycles.

Turning to FIG. 8, in one embodiment of this disclosure, a control panel 380 incorporates an operator interface consisting of a program selector knob 700, which can be a mechanic selector switch or part of a touch screen display. In one version of this interface, the operator may choose from various programs corresponding to different flow ranges. FIG. 8 depicts four ranges: low flow 701, medium flow 702, medium high flow 703, and high flow 704. By operating the depicted knob 700, the operator (not shown) can select the desired flow range.

After observation of the biomass distribution on the grate for a period of, for example, a few seconds, the operator identifies whether the biomass is depositing evenly across the depth or it is accumulating the back or front of the grate. The operator can then adjust the control as required for the proper flow range to achieve even deposition of biomass on the grate.

Turning to FIGS. 9A, 9B, 9C and 9D, these figures depict equal time pressure steps generated by various positions of the interface program selecting knob. In particular, after changing the flow setting by, for example, turning knob 700 of FIG. 8, the operator can observe the impact on biomass distribution.

Figure 9:
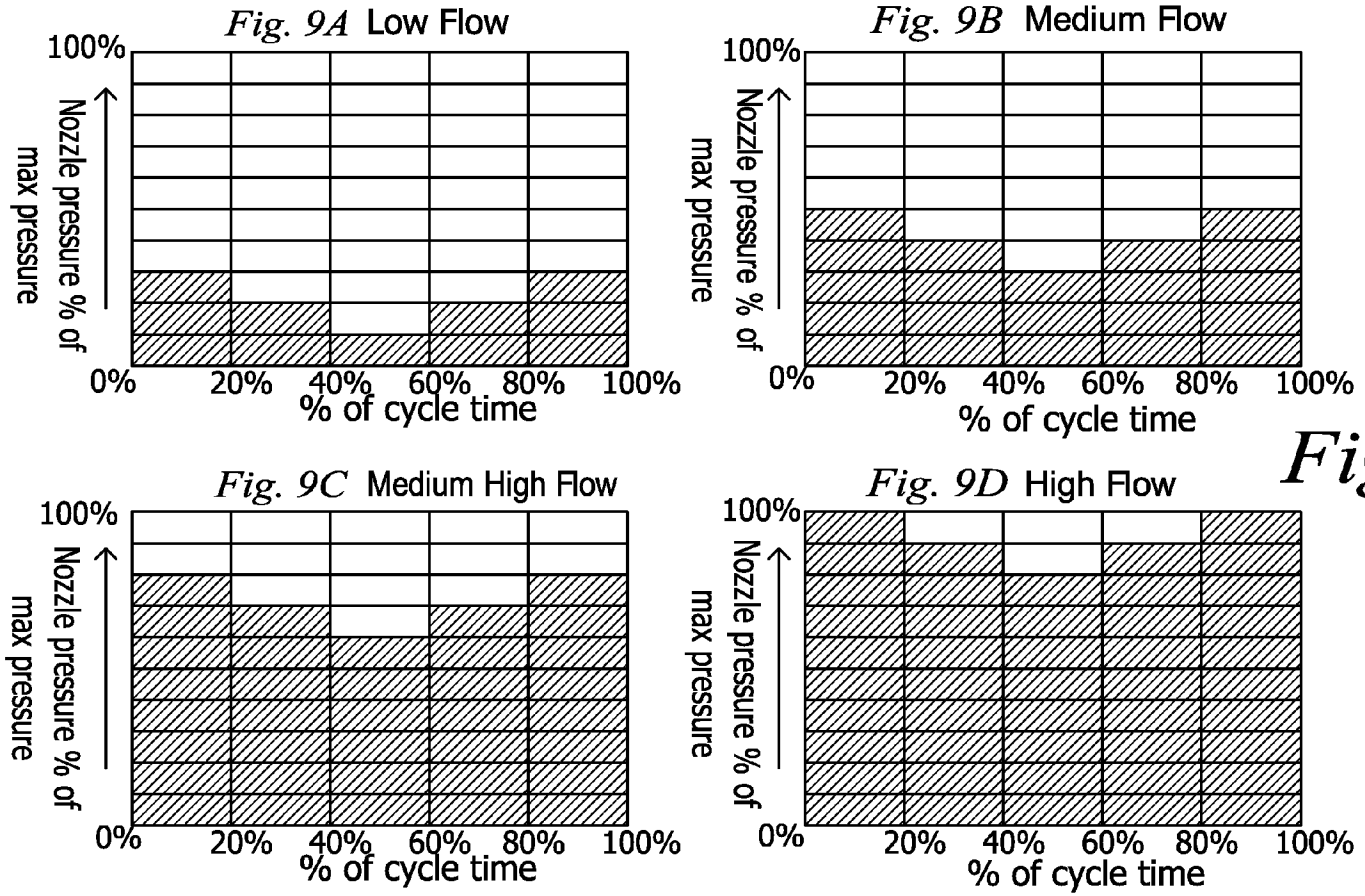
FIGS. 9A, 9B, 9C and 9D depict graphs of nozzle pressure versus cycle time for a system constructed in accordance with this disclosure.

FIG. 9A depicts nozzle pressure (as a percentage of maximum nozzle pressure) versus the percentage of cycle time for the low flow range setting 701 of FIG. 8. FIG. 9B depicts nozzle pressure (as a percentage of maximum nozzle pressure) versus the percentage of cycle time for the medium flow range setting 702 of FIG. 8. FIG. 9C depicts nozzle pressure (as a percentage of maximum nozzle pressure) versus the percentage of cycle time for the medium high flow range setting 703 of FIG. 8. FIG. 9D depicts nozzle pressure (as a percentage of maximum nozzle pressure) versus the percentage of cycle time for the high flow range setting 704 of FIG. 8.

Figure 10:
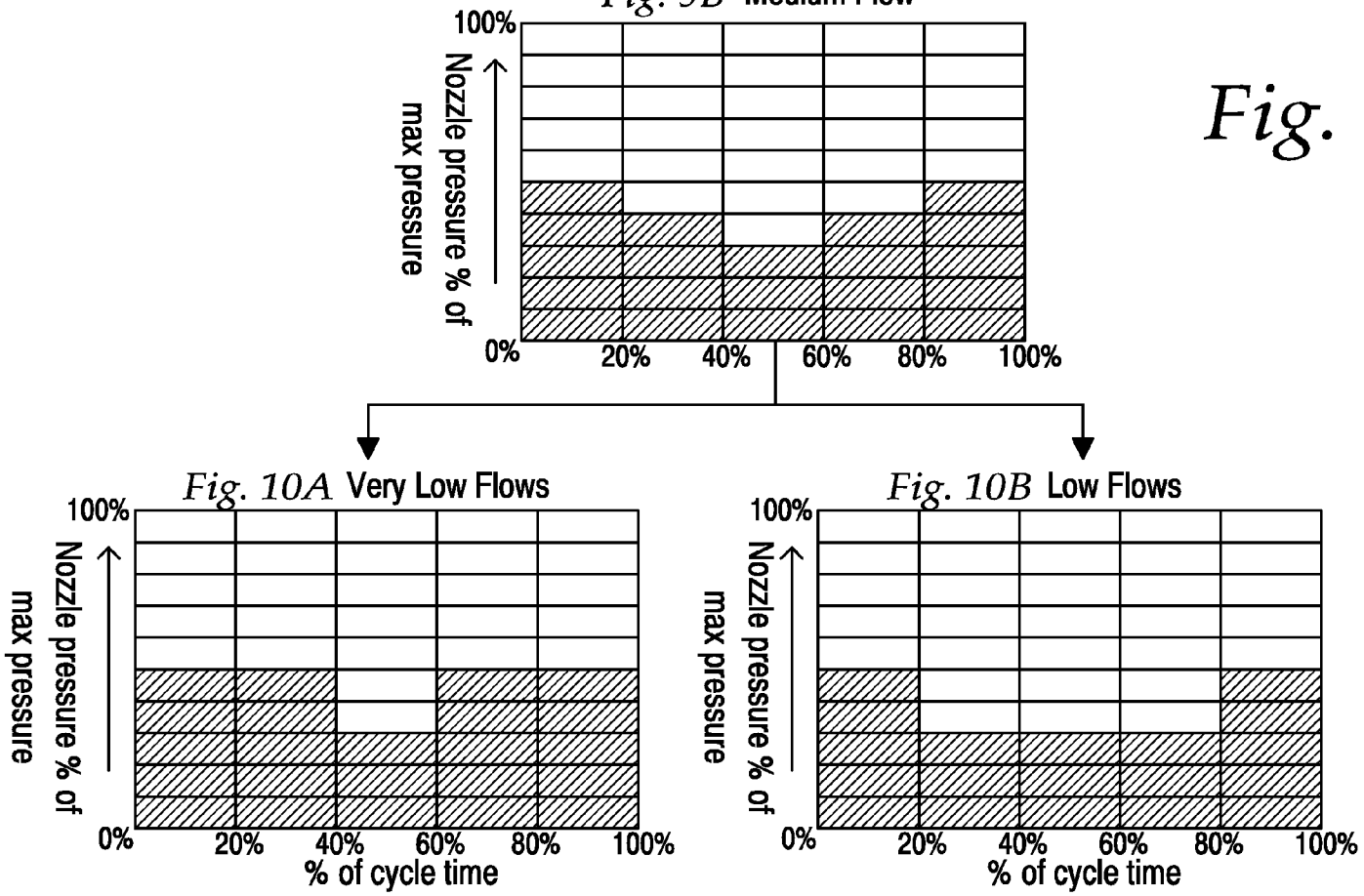
FIGS. 10A and 10B depict graphs of nozzle pressure versus cycle time for a system constructed in accordance with this disclosure.

FIGS. 10A and 10B depict graphs that correspond to programs that target the medium flow range. These graphs depict nozzle pressure (as a percentage of maximum nozzle pressure) against percent of cycle time.

FIG. 11 depicts a stoker boiler 500 constructed in accordance with this disclosure. As illustrated, a first observer 501 and a second observer 502 can view the operation of the boiler 500. Turning to FIG. 11B, the second observer 502 can be disposed near to the control device 380.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It is intended that the scope of the disclosure not be limited by the specification, but be defined by the claims set forth below. For example, while various specific dimensions were disclosed to better enable a person of skill in the art to easily reproduce the disclosed device without undue experimentation, different dimensions could be used and still fall within the coverage of the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. An automated biomass distribution system comprising:

i) a local control device unit adapted to generate a set of control signals;

ii) a set of converters connected to said local control device, wherein each converter within said set of converters is adapted to receive a subset of control signals of said set of control signals and convert said received subset of control signals into a set of air pressure signals;

iii) a set of actuators connected to said set of converters respectively, wherein each actuator within said set of actuators receives said set of air pressure signals from a corresponding converter within said set of converters;

iv) a set of valve plugs operatively coupled to said set of actuators through a set of spindles respectively, wherein each valve plug within said set of valve plugs is actuated by a corresponding actuator within said set of actuators through a spindle within said set of spindles in response to each air pressure signal within said set of air pressure signals; and v) a set of discharge ducts operatively coupled to a set of biomass distributors, wherein:

1) said set of biomass distributors are attached to a furnace of a boiler stoker and adapted to receive biomass, wherein said furnace includes a grate for burning said biomass;

2) each discharge duct within said set of discharge ducts receives a portion of a corresponding valve plug within said set of valve plugs to form a throttling passage to regulate airflow moving into a corresponding biomass distributor through said throttling passage, wherein said airflow moves biomass over said grate, a nozzle pressure of said airflow corresponds to an air pressure signal within said set of air pressure signals, and said airflow is provided by an air supplier through a main duct; and 3) a front end of each valve plug within said set of valve plugs and a rear end of a corresponding discharge duct within said set of discharge ducts have substantially the same shape, and wherein said nozzle pressure of said airflow is increased when said throttling passage is decreased and said nozzle pressure of said airflow is decreased when said throttling passage is increased.

2. The automated biomass distribution system of claim 1 wherein the valve plug is substantially diamond shaped.

3. The automated biomass distribution system of claim 1 wherein said central control unit runs a software program to control said nozzle pressure of said air flow from each discharge duct within said set of discharge ducts.

4. The automated biomass distribution system of claim 1 wherein said local control device is further adapted to store a set of programs wherein each program within said set of programs defines a set of programmed pulses within a cycle, each programmed pulse within said set of programmed pulses defining a first control signal sent to a corresponding converter and a duration of said first control signal.

* * * * *